US007338280B2

(12) United States Patent
Wong

(10) Patent No.: US 7,338,280 B2
(45) Date of Patent: Mar. 4, 2008

(54) INTERCHANGEABLE PIEZOELECTRIC LIGHTER

(75) Inventor: Ming King Wong, North Point (HK)

(73) Assignee: Colibri Corporation, Providence, RI (US)

( * ) Notice: Subject to any disclaimer, the term of this patent is extended or adjusted under 35 U.S.C. 154(b) by 1513 days.

(21) Appl. No.: 09/840,426

(22) Filed: Apr. 20, 2001

(65) Prior Publication Data

US 2002/0155408 A1 Oct. 24, 2002

(51) Int. Cl.

| | |
|---|---|
| ***F23D 14/58*** | (2006.01) |
| ***F23D 14/54*** | (2006.01) |
| ***F23D 14/48*** | (2006.01) |
| ***F23Q 2/167*** | (2006.01) |
| ***F23Q 2/173*** | (2006.01) |

(52) U.S. Cl. ..... 431/28; 431/278; 431/280; 431/281; 431/344; 431/255; 239/393; 222/3

(58) Field of Classification Search ..... 431/241, 431/242, 153, 255, 249, 251, 344, 354, 355, 431/278, 279, 280, 281; 239/393, 392, 563; 222/3; 137/893; 362/209

See application file for complete search history.

(56) References Cited

U.S. PATENT DOCUMENTS

| | | | | | |
|---|---|---|---|---|---|
| 284,631 | A | * | 9/1883 | Hall | 239/394 |
| 397,903 | A | * | 2/1889 | Folmer | 431/280 |
| 521,165 | A | * | 6/1894 | House et al. | 239/563 |
| 562,410 | A | * | 6/1896 | Moon | 137/606 |
| 594,922 | A | * | 12/1897 | Webster | 239/295 |
| 675,638 | A | * | 6/1901 | Noel | 431/355 |
| 773,203 | A | * | 10/1904 | Fosdick | 239/394 |
| 788,382 | A | * | 4/1905 | Taylor | 431/355 |
| 832,159 | A | * | 10/1906 | Pratt | 431/355 |
| 987,459 | A | * | 3/1911 | Harrison et al. | 431/355 |
| 1,262,354 | A | * | 4/1918 | Kemper | 431/355 |
| 1,639,328 | A | * | 8/1927 | Coberly | 239/128 |
| 1,844,481 | A | * | 2/1932 | Rogers | 431/139 |
| 1,852,862 | A | * | 4/1932 | Smelik et al. | 239/394 |
| 1,872,408 | A | * | 8/1932 | Coberly | 266/77 |
| 2,697,485 | A | * | 12/1954 | McNally | 431/280 |
| 3,245,234 | A | * | 4/1966 | Kanamaru | 431/152 |
| 3,309,902 | A | * | 3/1967 | Kanamaru | 431/277 |
| 4,904,182 | A | * | 2/1990 | Leshner | 431/354 |
| 5,308,240 | A | * | 5/1994 | Lowenthal | 431/131 |

* cited by examiner

*Primary Examiner*—Carl D. Price
(74) *Attorney, Agent, or Firm*—Salter & Michaelson

(57) ABSTRACT

An interchangeable piezoelectric lighter includes a casing having a switcher cavity and a valve switcher rotatably received in the switcher cavity wherein the valve switcher includes at least two gas nozzles axially provided therein. The gas nozzles are adapted for selectively and coaxially aligning with a gas valve for producing different types flames. Therefore, by rotatably switching the valve switcher, the gas valve is adapted to align with the respective gas nozzle for a releasing gas passing therethrough, so as to produce a desired type of flame.

28 Claims, 4 Drawing Sheets

INTERCHANGEABLE PIEZOELECTRIC LIGHTER

BACKGROUND OF THE PRESENT INVENTION

1. Field of Invention

The present invention relates to piezoelectric lighters, and more particularly to an interchangeable piezoelectric lighter which is adapted for selectively interchanging a type of flame between a visible flame, a torch flame, and a windproof flame.

2. Description of Related Arts

Piezoelectric lighters have been known and sold throughout the United States. The conventional piezoelectric lighters are generally classified into two categories which is the visible flame type piezoelectric lighter and the torch flame type piezoelectric lighter. The visible flame type piezoelectric lighter, such as a cigarette lighter, allows gas emitted from the nozzle directly burned in the air to produce a regular visible flame. A windproof type piezoelectric lighter, has a re-igniting properties wherein an ignition element is heated up when igniting the lighter in such a manner that once the flame is blown out, the ignition element remains in high temperature and re-ignites the emitted gas to regain the flame. Thus, a torch lighter is adapted for providing a high temperature torch flame wherein the torch flame is more powerful than the visible flame so as to increase the burning purpose of the lighter.

For smokers, especially cigar and pipe smokers, do not ready like to use the torch flame type piezoelectric lighter since the high temperature torch flame will destroy the taste of the tobacco. However, it is a hassle for the smoker to light a cigarette or a cigar outdoors while using the visible flame type piezoelectric lighter. Thus, it is inconvenient for the smokers to carry different types of lighter at once.

Moreover, an improved piezoelectric lighter is adapted for selecting the flame by manipulating an ignition button wherein when a downward force is applied on the ignition button to depress the ignition button, such lighter provides a torch flame and when the downward force is released, the lighter provides a visible flame. However, a user must manipulate the ignition button and leads to different operational results depending on the user, which may be considered disadvantageous in practical use. Thus, the lighter must require other parts to incorporate therewith for controlling a flow of gas. Generally, a lighter cap is incorporated with the lighter for actuating a valve thereof such that when the lighter cap is opened, the gas is released from the gas chamber through the valve. This adverse result affects the ease of leaking the gas from the gas chamber. So, such improved lighter still has drawbacks in practical use and hence there has been a demand for an interchangeable lighter which is improved in both safety and operability.

SUMMARY OF THE PRESENT INVENTION

A main object of the present invention is to provide an interchangeable piezoelectric lighter which is adapted for selectively interchanging a type of flame between a visible flame, torch flame, and a windproof flame.

Another object of the present invention is to provide an interchangeable piezoelectric lighter which produces both visible flame, windproof flame, and torch flame for selectively lighting a cigarette, cigar and pipe conveniently.

Another object of the present invention is to provide an interchangeable piezoelectric lighter wherein the visible flame, the torch flame, and the windproof flame are selectively produced by controlling a flame interchanging means such that no mechanism is required for users to manipulate in order to select the flame such as the ignition button.

Another object of the present invention is to provide an interchangeable piezoelectric lighter wherein the lighter is improved in both safety and operability. A user selects a desired flame by manipulating the flame interchanging means and then ignites the lighter in one single action, which is advantageous in practical use.

Accordingly, in order to accomplish the above objects, the present invention provides an interchangeable piezoelectric lighter, comprising:

- a casing receiving a liquefied gas storage and a switcher cavity provided therein;
- a gas valve operatively extended from the liquefied gas storage for controlling a flow of gas;
- a piezoelectric unit fitted in the casing for generating piezoelectricity;
- an ignition button slidably fitted in the casing in a vertically movable manner wherein the ignition button is attached to a top end of the piezoelectric unit and arranged to compress the piezoelectric unit when the ignition button is depressed; and
- a flame interchanging means for selectively interchanging a flame of the piezoelectric lighter, comprising a valve switcher movably received in the switcher cavity wherein the valve switcher comprises at least two gas nozzles selectively and coaxially aligning with the gas valve for the flow of gas passing therethrough so as to produce different flames.

DETAILED DESCRIPTION OF THE PREFERRED EMBODIMENT

Figure 1:
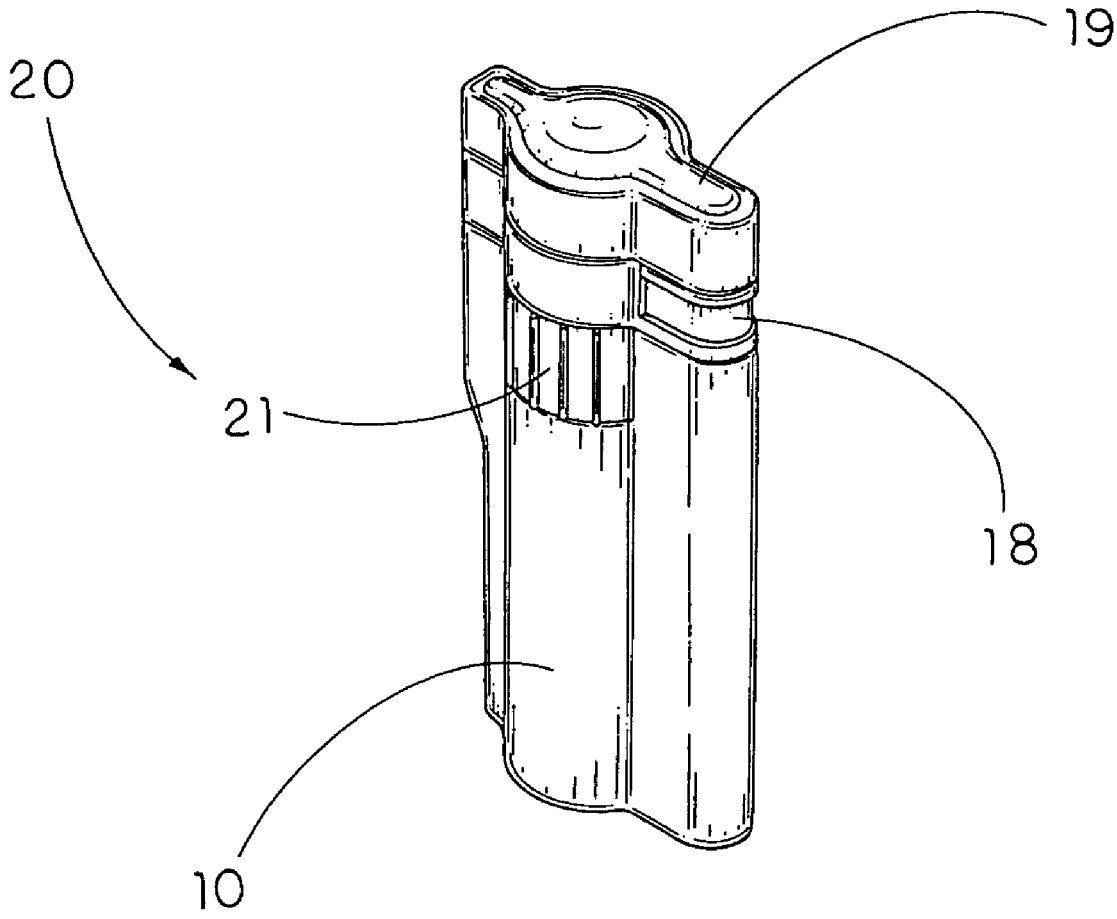
FIG. 1 is a perspective view of an interchangeable piezoelectric lighter according to a preferred embodiment of the present invention.
Figure 2:
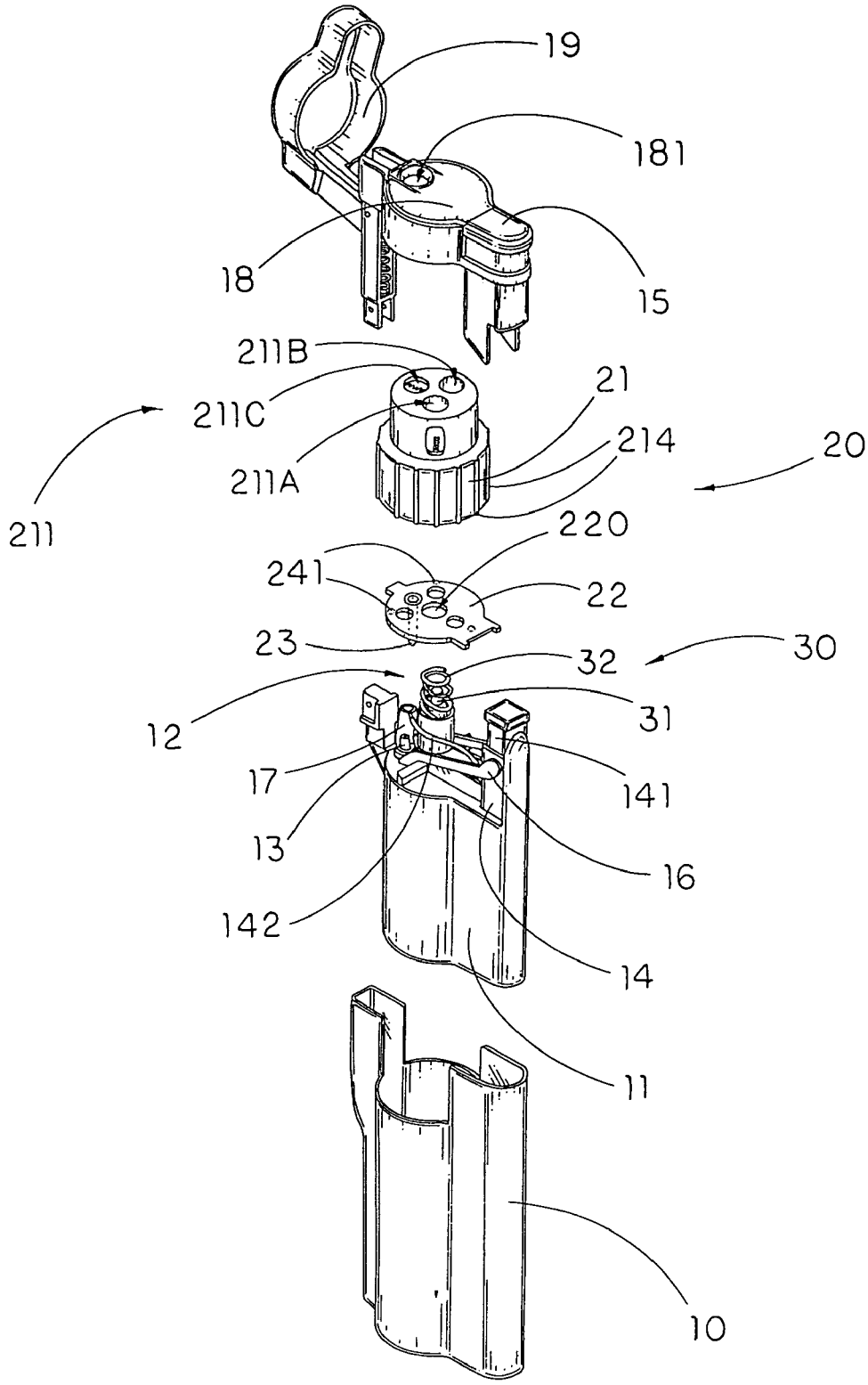
FIG. 2 is an exploded perspective view of the interchangeable piezoelectric lighter according to the above preferred embodiment of the present invention.
Figure 3:
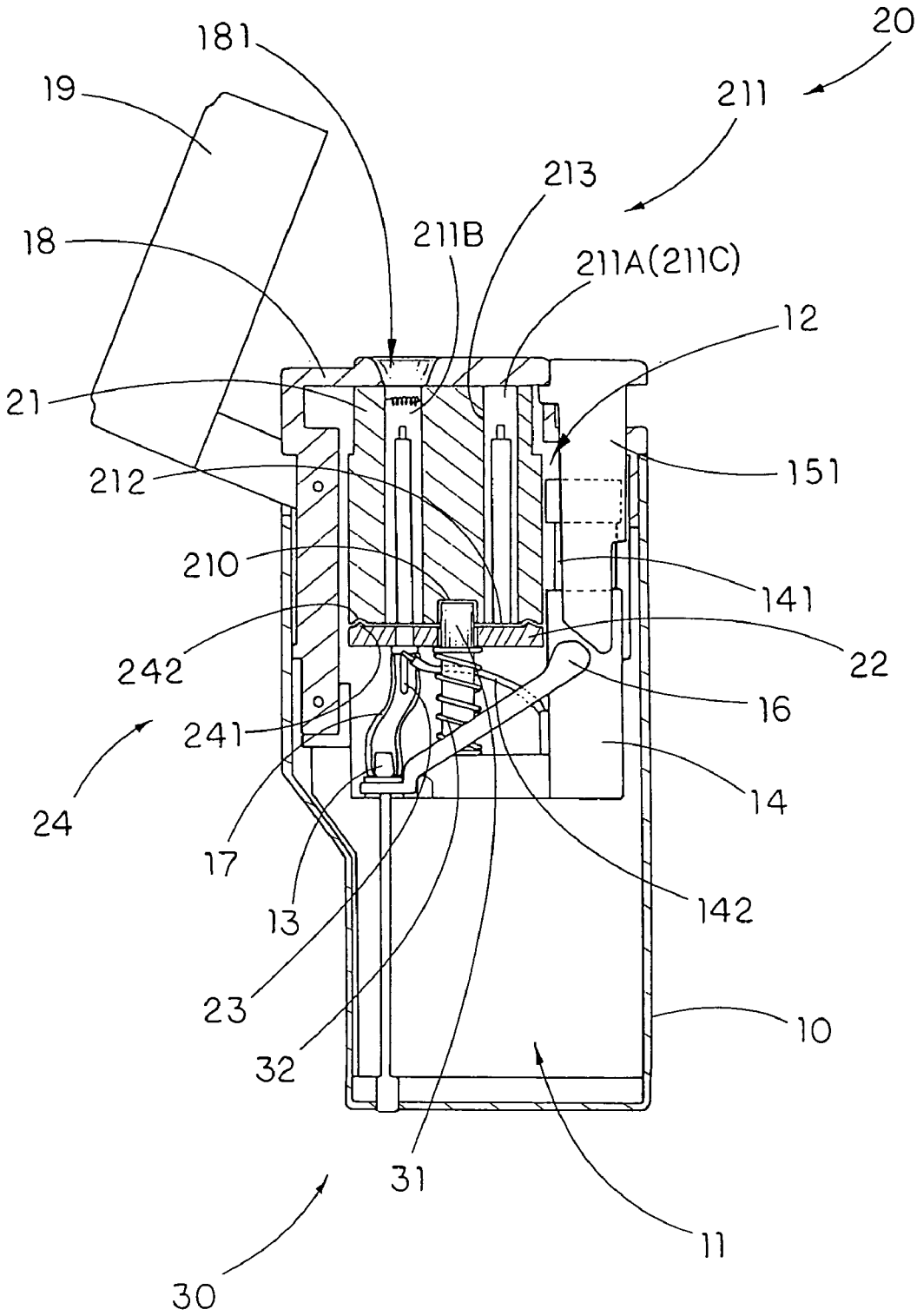
FIG. 3 is a sectional view of the interchangeable piezoelectric lighter according to the above preferred embodiment of the present invention.

Referring to FIGS. 1 to 3 of the drawings, an interchangeable piezoelectric lighter according to a preferred embodiment of the present invention is illustrated. The interchangeable piezoelectric lighter, such as a standard piezoelectric lighter, comprises a casing 10 receiving a liquefied gas storage 11 and a switcher cavity 12 provided therein, a gas valve 13 operatively extended from the liquefied gas storage 11 for controlling a flow of gas, a piezoelectric unit 14 fitted in the casing 10 for generating piezoelectricity, and an ignition button 15 slidably fitted in the casing 10 in a vertically movable manner.

The piezoelectric unit 14, which is disposed in the casing 10, comprises a movable operating part 141 extended upwardly and an ignition tip 142 extended to a position towards to the gas valve 13, wherein when the movable operating part 141 is depressed downwardly, the ignition tip 142 generates sparks to ignite the gas emitted from the gas valve 13 at the same time.

The ignition button 15 is attached to a top end of the movable operating part 141 of the piezoelectric unit 13 and operatively connected to the gas valve 13 via a gas lever 16. Accordingly, when the ignition button 15 is pushed downward, the movable operating part 141 of the piezoelectric unit 14 is compressed for generating piezoelectricity through and out the ignition tip 142. At the same time, the gas lever 16 is simultaneously pressed by the ignition button 15 to release gas through the gas valve 13 so as to ignite the releasing gas by the spark from the ignition tip 142.

The interchangeable piezoelectric lighter further comprises a flame interchanging means 20 for selectively interchanging a flame of the piezoelectric lighter, comprising a valve switcher 21 movably received in the switcher cavity 12 in a rotatably movable manner wherein the valve switcher 21 comprises at least two gas nozzles 211 selectively and coaxially aligning with the gas valve 13 for the flow of gas passing therethrough so as to produce different flames.

The valve switcher 21 has a lower portion exposed to an exterior of the casing 10 wherein a plurality of flanges 214 are spacedly protruded on an outer circumferential surface of the lower portion of the valve switcher 21 for being rotated easily and an upper portion rotatably received in a cover 18 which is supported on the casing 10. The cover 18 has a through hole 181 provided thereon and arranged to align with gas valve 13 for the flame passing through. Thus, a cap 19 is pivotally mounted on the cover 18 for protecting the valve nozzle 211.

The flame interchanging means 20 further comprises a gas adapter 22 fitted in the switcher cavity 12 wherein the valve switcher 21 is supported thereon and a gas emitter 22, made of conductive material, having an inlet end operatively extended from the gas valve 13 and a gas releasing end penetrated through the gas adapter 22 so as to selectively align with one of the gas nozzles 211, 212.

According to the preferred embodiment, the valve switcher 21 having a circular shaped rotatably and sealedly mounted on the gas adapter 22 wherein the valve switcher 21 comprises three gas nozzles 211, which are a visible gas nozzle 211*a*, a torch nozzle 211*b*, and a windproof nozzle 211*c*, axially provided on the valve switcher 21 respectively, so as to selectively align with the gas emitter 23. Each of the three gas nozzles 211 has a nozzle head 213 appearing from a ceiling of the valve switcher 21 and a gas inlet 212 provided on a bottom surface of the valve switcher 21 and adapted for sealedly aligning with the gas releasing end of the gas emitter 23 such that the releasing gas is adapted for transmitting from the gas valve 13 to the respective gas nozzle 211 through the gas emitter 23, as shown in FIG. 3.

Accordingly, a gas conduit 17, which is made of non-conductive material such as plastic, is connected between the gas valve 13 and the gas emitter 23 wherein the ignition tip 142 is extended to a position close to the gas emitter 23 in such a manner that the piezoelectricity generated by the piezoelectric unit 14 is transmitted to the gas emitter 23 by conduction for igniting the releasing gas from the gas valve 13. However, the piezoelectricity cannot transmit to the gas valve 13 through the gas conduit 17 because the gas conduit 17 functions as a resistance for resisting the piezoelectricity transmitting therethrough.

The flame interchanging means 20 further comprises a guiding unit 24 for guiding the gas emitter 23 aligned with the respective gas nozzle 211 wherein the guiding unit 24 comprises at least a protrusion 241 upwardly provided on a top surface of the gas adapter 22 and at least a corresponding indention 242 formed on a bottom surface of the valve switcher 21 in such a manner that the protrusion 241 is fittedly engaged with the indention 242 when the gas emitter 23 is aligned with the respective gas nozzle 211, so as to ensure the alignment thereof.

The interchangeable piezoelectric lighter further comprises a supporting frame 30 comprising a central shaft 31 upwardly extended from the switcher cavity 12 wherein the valve switcher 21 is rotatably supported by the central shaft 31 and a resilient element 32 coaxially mounted on the central shaft 31 for applying an urging force against the gas adapter 22.

Accordingly, the valve switcher 21 has a center slot 210 coaxially formed on a bottom surface thereof and the gas adapter 22 has a center through hole 220 coaxially formed thereon in such a manner that the central shaft 31 is penetrated through the center through hole 220 of the gas adapter 22 and rotatably inserted into the center slot 210 of the valve switcher 21.

The resilient element 32, which is a compression spring, is adapted for applying an urging force against the gas adapter 22 to push it upwardly wherein the resilient element 32 has two ends biasing against a base of the central shaft 31 and a bottom surface of the gas adapter 22. Accordingly, the resilient element 32 normally urges and retains the gas adapter 22 in a higher position that the top surface of the gas adapter 22 is tightly contacted with a bottom surface of the valve switcher 21, so as to ensure the gas emitter 23 sealedly aligned with the respective gas nozzle 211 for gas transmitting therebetween.

In order to operate the interchangeable piezoelectric lighter, a user is able to select a type of flame by rotating the valve switcher 21 until the respective gas nozzle 211 is aligned with the gas emitter 23. Then, a downward force must be applied on the ignition button 15 to compress the piezoelectric unit 14 to ignite the piezoelectric lighter of the present invention, as the same as the ignition of the conventional lighter. So, the user does not have to manipulate any part of the lighter to select the flame during the ignition process, which is advantageous in practical use. Thus, for safety purpose, the gas is released from the gas valve 13 which is actuated by the ignition button 15 such that when the downward force is released on the ignition button 15, the gas valve 13 is shut off for preventing the gas releasing accidentally.

Figure 4:
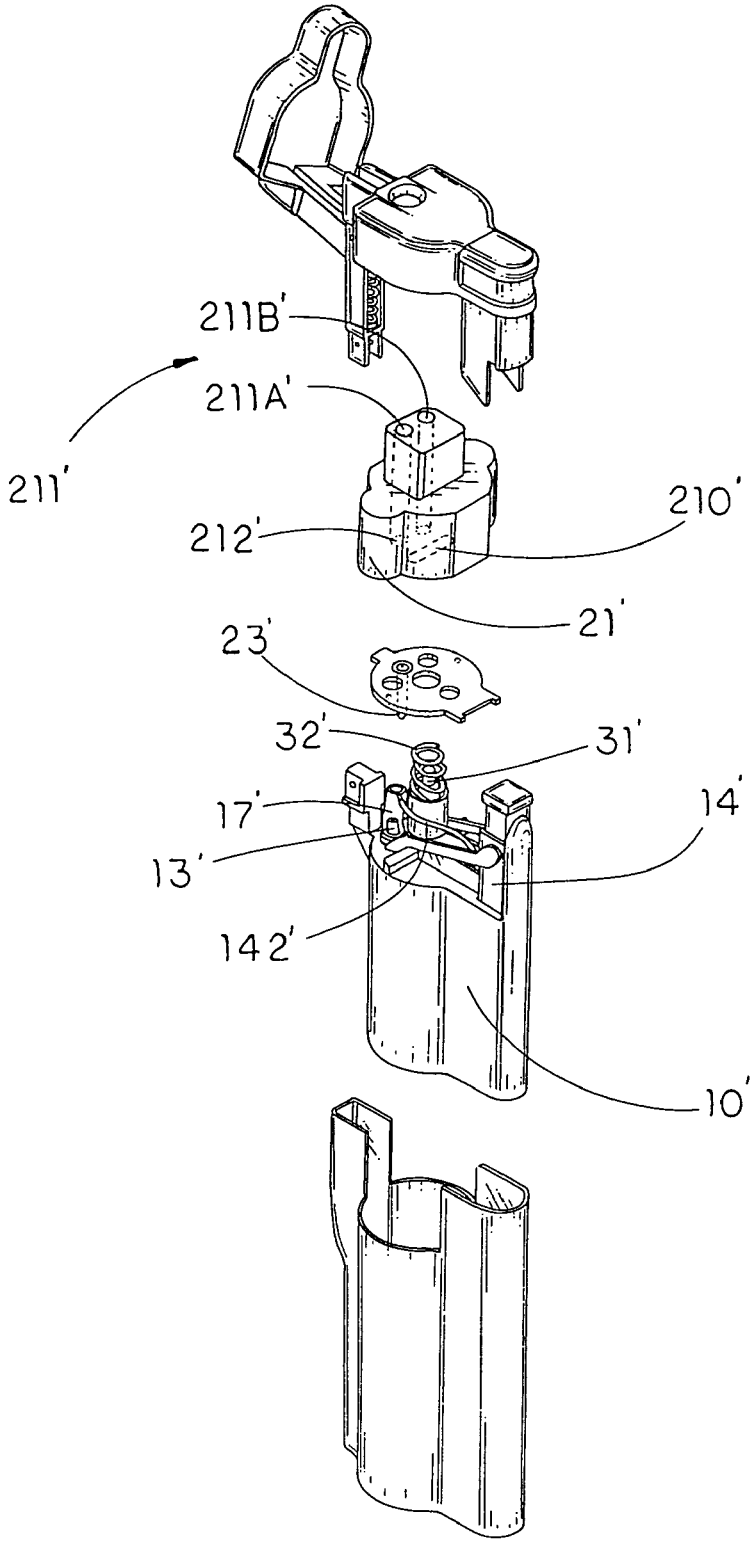
FIG. 4 illustrates an alternative mode of a flame interchanging means of the interchangeable piezoelectric lighter according to the above preferred embodiment of the present invention.

FIG. 4 illustrates an alternative mode of the flame interchanging means 20' wherein the valve switcher 21' movably received in the switcher cavity 12' in a horizontally movable manner and arranged to be movably supported on the gas adapter 22'. The valve switcher 21' comprises two gas nozzles 211' which are a visible nozzle 211*a*' and a torch flame 211*b*' parallelly provided on the valve switcher 21' respectively, so as to selectively align with the gas emitter 23'. Each of the two gas nozzles 211' has a nozzle head 213' appearing from a ceiling of the valve switcher 21' and a gas inlet 212' provided on a bottom surface of the valve switcher 21' and adapted for sealedly aligning with the gas releasing end of the gas emitter 23' such that the releasing gas is adapted for transmitting from the gas valve 13' to the respective gas nozzle 211' through the gas emitter.

Accordingly, the valve switcher 21' has an elongated guiding slot 210' transversely formed on the bottom surface thereof wherein a head portion of the central shaft 31' of the supporting frame 30' is fitted into the elongated slot 210' in such a manner that the valve switcher 21' is adapted for slidably moving on the gas adapted 22' in a horizontally movable manner. Thus, the guiding slot 210' has a predetermined length adapted for each of the gas nozzles 211' coaxially aligning with the gas emitter 23' and for reinforcing the displacement of the valve switcher 21' so as to prevent the valve switcher 21' departing from the gas adapter 22' when the valve switcher 21' is being pushed.

So, the user is able to select the type of flame by pushing the valve switcher 21' horizontally so as to line up the one of the gas nozzles 211' to the gas emitter 23'. Then the user can simply ignite the piezoelectric lighter of the present invention by pressing the ignition button 15' downwardly as the conventional lighter.

What is claimed is:

1. An interchangeable piezoelectric lighter, comprising:

a casing receiving a liquefied gas storage and having a switcher cavity provided therein;

a gas valve operatively extended from said liquefied gas storage for controlling a flow of gas;

a piezoelectric unit fitted in said casing for generating piezoelectricity;

an ignition button mounted to said casing in a movable manner, wherein said ignition button is arranged to activate said piezoelectric unit when said ignition button is depressed;

a gas emitter operatively coupled from said piezoelectric unit;

and a flame interchanging means for selectively interchanging a flame of said piezoelectric lighter, comprising a valve switcher movably received in said switcher cavity, wherein said valve switcher comprises at least two parallel arranged gas nozzles selectively and coaxially aligning with said gas emitter for said flow of gas passing therethrough so as to produce different flames;

said gas nozzles including a windproof type nozzle and a non-windproof type nozzle;

said gas nozzles each including a nozzle head and an inlet communicating with said gas va vc;

said valve switcher including a lower portion that is exposed through an aperture in said casting to enable exterior manual rotation thereof and an upper portion for supporting each nozzle head;

said lower portion of said valve switcher being manually movable in a direction orthogonal to the axis of both said gas nozzles so as to selectively and coaxially align said respective nozzles with said gas emitter.

2. An interchangeable piezoelectric lighter as recited in claim 1, wherein said flame interchanging means further comprises a gas adapter fitted in said switcher cavity wherein said valve switcher is supported on said gas adapter and a wherein said gas emitter has an inlet end operatively extended from said gas valve and a gas releasing end penetrated though said gas adapter so as to selectively align with one of said gas nozzles.

3. An interchangeable piezoelectric lighter, as recited in claim 1, wherein said valve switcher in constructed and arranged to coaxially rotate about a common axis and with respect to said gas emitter.

4. An interchangeable piezoelectric lighter, as recited in claim 1, wherein said valve switcher is constructed and arranged to move in a direction that is orthogonal to a common axis and with respect to said gas emitter.

5. An interchangeable piezoelectric lighter, as recited in claim 1, wherein said gas nozzles are of different type.

6. An interchangeable piezoelcetric lighter, as recited in claim 5, wherein said gas nozzles include at least a visible nozzle and a torch nozzle.

7. An interchangeable piezoelectric lighter, comprising:

a casing receiving a liquefied gas storage and having a switcher cavity provided therein;

a gas valve operatively extended from said liquefied gas storage for controlling a flow of gas;

a piezoelectric unit fitted in said casing for generating piezoelectricity;

an ignition button mounted to said casing in a movable manner, wherein said ignition button is arranged to compress said piezoelectric unit when said ignition button is depressed;

a gas emitter opcratively coupled from said piezoelectric unit;

and a flame interchanging means for selectively interchanging a flame of said piezoelectric lighter, comprising a valve switcher movably received in said switcher cavity, wherein said valve switcher comprises at least two gas nozzles that are arranged parallel to a common axis of the casing and selectively and coaxially aligning with said gas emitter for said flow of gas passing therethrough so as to produce different flames;

wherein said flame interchanging means further comprises a gas adapter fitted in said switcher cavity wherein said valve switcher is supported on said gas adapter and a said gas emitter having an inlet end operatively extended from said gas valve and a gas releasing end penetrated through said gas adapter so as to selectively align with one of said gas nozzles;

wherein said flame interchanging means further comprises a guiding unit for guiding said gas emitter aligned with said respective gas nozzle wherein said guiding unit comprises at least a protrusion upwardly provided on a top surface of said gas adapter and at least a corresponding indention formed on said bottom surface of said valve switcher in such a manner that said protrusion is fittedly engaged with said indention when said gas emitter is aligned with one of said gas nozzles.

8. An interchangeable piezoelectric lighter, comprising:

a casing receiving a liquefied gas storage and having a switcher cavity provided therein;

a as valve operatively extended from said liquefied gas storage for controlling a flow of gas;

a piezoelectric unit fitted in said casing for generating piezoelectricity;

an ignition button mounted to said casing in a movable manner, wherein said ignition button is arranged to compress said piezoelectric unit when said ignition button is depressed;

a gas emitter operatively coupled from said piezoelectric unit;

and a flame interchanging means for selectively interchanging a flame of said piezoelectric lighter, comprising a valve switcher movably received in said switcher cavity, wherein said valve switcher comprises at least two gas nozzles selectively and coaxially aligning with said gas valve for said flow of gas passing therethrough so as to produce different flames;

wherein said flame interchanging means further comprises a gas adapter fitted in said switcher cavity wherein said valve switcher is supported on said gas adapter and a said gas emitter having an inlet end operatively extended from said gas valve and a gas releasing end penetrated through said gas adapter so as to selectively align with one of said gas nozzles;

wherein said valve switcher, which is adapted for coaxially rotating about a common axis of the casing with respect to said gas adapter, comprises three gas nozzles which are a visible gas nozzle, a torch nozzle, and a windproof nozzle axially provided on said valve switcher respectively, so as to selectively align with said gas emitter, each of said three gas nozzles having a nozzle head appearing from a ceiling of said valve switcher and a gas inlet provided on a bottom surface of said valve switcher and adapted for sealedly aligning with said gas releasing end of said gas emitter;

wherein said flame interchanging means further comprises a guiding unit for guiding said gas emitter aligned with said respective gas nozzle wherein said guiding unit comprises at least a protrusion upwardly provided on a top surface of said gas adapter and at least a corresponding indention formed on said bottom surface of said valve switcher in such a manner that said protrusion is fittedly engaged with said indention when said gas emitter is aligned with one of said gas nozzles.

9. An interchangeable piezoelectric lighter, as recited in claim 8, further comprising a supporting frame comprising a central shaft, upwardly extended from said switcher cavity, for rotatably supporting said central shaft and a resilient element coaxially mounted on said central shaft for applying an urging force against said gas adapter, wherein said valve switcher has a center slot coaxially formed on said bottom surface thereof and said gas adapter has a center through hole coaxially formed thereon in such a manner that said central shaft is penetrated through said center through hole of said gas adapter and rotatably inserted into said center slot of said valve switcher.

10. An interchangeable piezoelectric lighter, as recited in claim 9, wherein said resalient element is a compression spring having two ends biasing against a base of said central shaft and a bottom surface of said gas adapter, and wherein said resilient element normally urges and retains said gas adapter in a higher position that said top surface of said gas adapter is tightly contacted with said bottom surface of said valve switcher, so as to ensure said gas emitter sealedly aligned with said respective gas nozzle for gas transmitting therebetween.

11. An interchangeable piezoelectric lighter, comprising:

a casing receiving a liquefied gas storage and having a switcher cavity provided therein;

a gas valve operatively extended from said liquefied gas storage for controlling a flow of gas;

a piezoelectric unit fitted in said casing for generating piezoelectricity;

an ignition button mounted to said casing in a movable manner, wherein said ignition button is arranged to compress said piezoelectric unit when said ignition button is depressed;

a gas emitter creatively coupled from said piezoelectric unit;

and a flame interchanging means for selectively interchanging a flame of said piezoelectric lighter, comprising a valve switcher movably received in said switcher cavity, wherein said valve switcher comprises at least two gas nozzles selectively and coaxially aligning with said gas emitter for said flow of gas passing therethrough so as to produce different flames;

wherein said flame interchanging means further comprises a gas adapter fitted in said switcher cavity wherein said valve switcher is supported on said gas adapter and said gas emitter having an inlet end operatively extended from said gas valve and a gas releasing end penetrated through said gas adapter so as to selectively align with one of said gas nozzles;

further comprising a supporting frame comprising a central shaft, upwardly extended from said switcher cavity, for rotatably supporting said central shaft and a resilient element coaxially mounted on said central shaft for applying an urging force against said gas adapter, wherein said valve switcher has a center slot coaxially formed on said bottom surface thereof and said gas adapter has a center though hole coaxially formed thereon in such a manner that said central shaft is penetrated through said center through hole of said gas adapter and rotatably inserted into said center slot of said valve switcher.

12. An interchangeable piezoelectric lighter, as recited in claim 11, wherein said resilient element is a compression spring having two ends biasing against abase of said central shaft and a bottom surface of said gas adapter, and wherein said resilient element normally urges and retains said gas adapter in a higher position that said top surface of said gas adapter is tightly contacted with said bottom surface of said valve switcher, so as to ensure said gas emitter sealedly aligned with said respective gas nozzle for gas transmitting therebetween.

13. An interchangeable piezoelectric lighter, comprising:

a casing receiving a liquefied gas storage and having a switcher cavity provided therein;

a gas valve operatively extended from said liquefied gas storage for controlling a flow of gas;

a piezoelectric unit fitted in said casing for generating piezoelectricity;

an ignition button mounted to said casing in a movable manner, wherein said ignition button is arranged to compress said piezoelectric unit when said ignition button is depressed;

a gas emitter operatively coupled from said piezoelectric unit;

and a flame interchanging means for selectively interchanging a flame of said piezoelectric lighter, comprising a valve switcher movably received in said switcher cavity, wherein said valve switcher comprises at least two gas nozzles selectively and coaxially aligning with said gas emitter for said flow of gas passing therethrough so as to produce different flames;

wherein said flame interchanging means further comprises a gas adapter fitted in said switcher cavity wherein said valve switcher is supported on said gas adapter and said gas emitter having an inlet end operatively extended from said gas valve and a gas releasing end penetrated through said gas adapter so as to selectively align with one of said gas nozzles;

wherein said valve switcher, which is adapted for coaxially rotating with respect to said gas adapter, comprises three gas nozzles which are a visible gas nozzle, a torch nozzle, and a windproof nozzle axially provided on said valve switcher respectively, so as to selectively align wit said gas emitter, each of said three gas nozzles having a nozzle head appearing from a ceiling of said valve switcher and a gas inlet provided on a bottom surface of said valve switcher and adapted for sealedly aligning with said gas releasing end of said gas emitter;

further comprising a supporting frame comprising a central shaft, upwardly extended from said switcher cavity, for rotatably supporting said central shaft and a resilient element coaxially mounted on said central shaft for applying an urging force against said gas adapter, wherein said valve switcher has a center slot coaxially formed on said bottom surface thereof and said gas adapter has a center through hole coaxially formed thereon in such a manner that said central shaft is penetrated through said center through hole of said gas adapter and rotatably inserted into said center slot of said valve switcher.

14. An interchangeable piezoelectric lighter, as recited in claim 13, wherein said resilient element is a compression spring having two ends biasing against a base of said central shaft and a bottom surface of said gas adapter, and wherein said resilient element normally urges and retains said gas adapter in a higher position that said top surface of said gas adapter is tightly contacted with said bottom surface of said valve switcher, so as to ensure said gas emitter sealedly aligned with said respective gas nozzle for gas transmitting therebetween.

15. An interchangeable piezoelectric lighter, comprising:

a casing receiving a liquefied gas storage and having a switcher cavity provided therein;

a gas valve operatively extended from said liquefied gas storage for controlling a flow of gas;

a piezoelectric unit fitted in said casing for generating piezoclectricity;

an ignition button mounted to said casing in a movable manner, wherein said ignition button is arranged to compress said piezoelectric unit when said ignition button is depressed;

a gas emitter operatively coupled from said piezoelectric unit;

and a flame interchanging means for selectively interchanging a flame of said piezoelectric lighter, comprising a valve switcher movably received in said switcher cavity, wherein said valve switcher comprises at least two gas nozzles having respective axes and selectively and coaxially aligning with said gas emitter for said flow of gas passing therethrough so as to produce different flames;

wherein said flame interchanging means further comprises a gas adapter fitted in said switcher cavity wherein said valve switcher is supported on said gas adapter and a said gas emitter having an inlet end operatively extended from said gas valve and a gas releasing end penetrated through said gas adapter so as to selectively align with one of said gas nozzles;

wherein said valve switcher, which is movably supported on said gas adapter in a direction which is transverse to the nozzle axes comprises two gas nozzles which are a visible nozzle and a torch flame parallelly providcd on said switcher respectively, so as to selectively align with said gas emitter, each of said two gas nozzles having a nozzle head appearing from a ceiling of said valve switcher and a gas inlet provided on a bottom surface of said valve switcher and adapted for sealedly aligning with said gas releasing end of said gas emitter.

16. An interchangeable piezoelectric lighter, as recited in claim 13, wherein said flame interchanging means further comprises a guiding unit for guiding said gas emitter aligned with said respective gas nozzle wherein said guiding unit comprises at least a protrusion upwardly provided on a top surface of said gas adapter and at least a corresponding indention formed on said bottom surface of said valve switcher in such a manner that said protrusion is fittedly engaged with said indention when said gas emitter is aligned with one of said gas nozzles.

17. An interchangeable piezoelectric lighter, as recited in claim 16, further comprising a supporting frame comprising a central shaft, upwardly extended from said switcher cavity, for rotatably supporting said central shaft and a resilient element coaxially mounted on said central shaft for applying an urging force against said gas adapter, wherein said valve switcher has an elongated guiding slot transversely formed on said bottom surface thereof and said gas adapter has a center through hole coaxially formed thereon in such a manner that said central shaft is penetrated through said center through hole of said gas adapter and slidably inserted into said guiding slot of said valve switcher.

18. An interchangeable piezoelectric lighter, as recited in claim 17, wherein said resilient element is a compression spring having two ends biasing against a base of said central shaft and a bottom surface of said gas adapter, and wherein said resilient element normally urges and retains said gas adapter in a higher position that said top surface of said gas adapter is tightly contacted with said bottom surface of said valve switcher, so as to ensure said gas emitter sealedly aligned with said respective gas nozzle for gas transmitting therebetween.

19. An interchangeable piezoelectric lighter, as recited in claim 17, wherein said valve switcher has a predetermined length adapted for each of said gas nozzles coaxially aligning with said gas emitter and for reinforcing a displacement of said valve switcher.

20. An interchangeable piezoelectric lighter, as recited in claim 19, wherein said resilient element is a compression spring having two ends biasing against a base of said central shaft and a bottom surface of said gas adapter, and wherein said resilient element normally urges and retains said gas adapter in a higher position that said top surface of said gas adapter is tightly contacted with said bottom surface of said valve switcher, so as to ensure said gas emitter sealedly aligned with said respective gas nozzle for gas transmitting therebetween.

21. An interchangeable piezoelectric lighter, as recited in claim 15, further comprising a supporting frame comprising a central shaft, upwardly extended from said switcher cavity, for rotatably supporting said central shaft and a resilient element coaxially mounted on said central shaft for applying an urging force against said gas adapter, wherein said valve switcher has an elongated guiding slot transversely formed on said bottom surface thereof and said gas adapter has a center through hole coaxially formed thereon in such a manner that said central shaft is penetrated through said center through hole of said gas adapter and slidably inserted into said guiding slot of said valve switcher.

22. An interchangeable piezoelectric lighter, as recited in claim 21, wherein said valve switcher has a predetermined length adapted for each of said gas nozzles coaxially aligning with said gas emitter and for reinforcing a displacement of said valve switcher.

23. An interchangeable piezoelectric lighter, as recited in claim 21, wherein said resilient element is a compression spring having two ends biasing against a base of said central shaft am a bottom surface of said gas adapter, and wherein said resilient element normally urges and retains said gas adapter in a higher position that said top surface of said gas adapter is tightly contacted with said bottom surface of said valve switcher, so as to ensure said gas emitter sealedly aligned with said respective gas nozzle for gas transmitting therebetween.

24. A lighter, comprising:

a casing receiving a liquefied gas storage and having a switcher cavity provided therein;

a gas valve operatively extended from said liquefied gas storage for controlling a flow of gas;

a piezoelectric unit fitted in said casing for generating piezoelectricity;

an ignition button mounted to said casing in a movable manner, wherein said ignition button is arranged to compress said piezoelectric unit when said ignition button is depressed;

a gas emitter operatively coupled from said piezoelectric unit:

and a valve switcher movably received in said switcher cavity;

wherein said valve switcher comprises at least two side-by-side arranged gas nozzles selectively and coaxially aligning with said gas emitter for said flow of gas passing therethrough so as to produce different flames;

said gas nozzles each including a nozzle head and an inlet communicating with said gas valve;

said valve switcher including a lower portion that is exposed through an aperture in said casing to enable exterior manual rotation thereof and an upper portion for supporting each nozzle head;

said lower portion of said valve switcher being manually movable in a direction orthogonal to an axis of both said gas nozzles so as to selectively and coaxially align said respective nozzles with said gas emitter.

25. An interchangeable piezoelectric lighter, as recited in claim 24, wherein said valve switcher in constructed and arranged to coaxially rotate about a common axis and with respect to said gas emitter.

26. An interchangeable piezoelectric lighter, as recited in claim 24, wherein said valve switcher is constructed and arranged to move in a direction that is orthogonal to a common axis and with respect to said gas emitter.

27. An interchangeable piezoelectric lighter, as recited in claim 24, wherein said gas nozzles are of different type.

28. An interchangeable piezoelectric lighter, as recited in claim 27, wherein said gas nozzles include at least a visible nozzle and a torch nozzle.

* * * * *